US008253643B2

(12) United States Patent
Kato et al.

(10) Patent No.: US 8,253,643 B2
(45) Date of Patent: Aug. 28, 2012

(54) CHIP ANTENNA AND ITS PRODUCTION METHOD, AND ANTENNA APPARATUS AND COMMUNICATIONS APPARATUS COMPRISING SUCH CHIP ANTENNA

(75) Inventors: Tomotsugu Kato, Saitama-ken (JP); Masayuki Gonda, Saitama-ken (JP); Hiroyuki Aoyama, Saitama-ken (JP); Hideto Mikami, Saitama-ken (JP)

(73) Assignee: Hitachi Metals Ltd., Tokyo (JP)

( * ) Notice: Subject to any disclaimer, the term of this patent is extended or adjusted under 35 U.S.C. 154(b) by 385 days.

(21) Appl. No.: 12/663,240

(22) PCT Filed: Jun. 9, 2008

(86) PCT No.: PCT/JP2008/060572

§ 371 (c)(1), (2), (4) Date: Jan. 29, 2010

(87) PCT Pub. No.: WO2008/150013

PCT Pub. Date: Dec. 11, 2008

(65) Prior Publication Data

US 2010/0156733 A1 Jun. 24, 2010

(30) Foreign Application Priority Data

Jun. 7, 2007 (JP) ..... 2007-151689

(51) Int. Cl.
*H01Q 1/00* (2006.01)

(52) U.S. Cl. ..... 343/787

(58) Field of Classification Search ..... 343/787, 343/700 MS, 702, 741, 872; 264/171.26; 252/62.63

See application file for complete search history.

(56) References Cited

U.S. PATENT DOCUMENTS

| | | | | |
|---|---|---|---|---|
| 5,541,616 | A | 7/1996 | Kawahata et al. | |
| 5,892,490 | A * | 4/1999 | Asakura et al. | 343/895 |
| 6,660,179 | B2 * | 12/2003 | Umeda et al. | 252/62.6 |
| 7,482,977 | B2 * | 1/2009 | Kuroda et al. | 343/700 MS |
| 7,821,468 | B2 * | 10/2010 | Aoyama et al. | 343/702 |
| 8,154,464 | B2 * | 4/2012 | Gonda et al. | 343/787 |
| 2004/0174318 | A1 | 9/2004 | Aisenbrey | |
| 2005/0253756 | A1 * | 11/2005 | Kuroda et al. | 343/700 MS |
| 2007/0279299 | A1 * | 12/2007 | Aoyama et al. | 343/702 |
| 2008/0036671 | A1 | 2/2008 | Gonda et al. | |
| 2009/0273534 | A1 * | 11/2009 | Gonda et al. | 343/787 |

FOREIGN PATENT DOCUMENTS

| | | | |
|---|---|---|---|
| JP | 49-040046 | A | 4/1974 |
| JP | 56-064502 | A | 6/1981 |
| JP | 05-022013 | A | 1/1993 |
| JP | 07-249931 | A | 9/1995 |
| JP | 09-507828 | A | 8/1997 |
| JP | 2000-209019 | A | 7/2000 |
| JP | 2003-146739 | A | 5/2003 |
| JP | 2004-297805 | A | 10/2004 |
| JP | 2005-278067 | A | 10/2005 |
| JP | 2006-319866 | A | 11/2006 |
| WO | 96/15078 | A | 5/1996 |
| WO | 2006/064839 | A1 | 6/2006 |

* cited by examiner

*Primary Examiner* — Huedung Mancuso
(74) *Attorney, Agent, or Firm* — Sughrue Mion, PLLC

(57) ABSTRACT

A chip antenna comprising a magnetic substrate comprising Z-type ferrite or Y-type ferrite as a main phase and having a through-hole extending linearly along a center axis, and a conductor penetrating the through-hole, the magnetic phase having a c-axis substantially parallel or perpendicular to the through-hole.

14 Claims, 8 Drawing Sheets

CHIP ANTENNA AND ITS PRODUCTION METHOD, AND ANTENNA APPARATUS AND COMMUNICATIONS APPARATUS COMPRISING SUCH CHIP ANTENNA

CROSS REFERENCE TO RELATED APPLICATIONS

This application is a National Stage of international Application No. PCT/JP2008/060572 filed Jun. 9, 2008, claiming priority based on Japanese Patent Application No. 2007-151689. filed Jun. 7, 2007, the contents of all of which are incorporated herein by reference in their entirety.

FIELD OF THE INVENTION

The present invention relates to a small chip antenna suitable for communications apparatuses having wide operating frequency bands, such as cell phones, mobile terminal gears, etc., its production method, and an antenna apparatus and a communications apparatus comprising such chip antenna.

BACKGROUND OF THE INVENTION

Antennas in mobile communications apparatuses such as cell phones, wireless LAN, etc., which are used in as wide frequency bands as several hundreds of MHz to several GHz (for instance, 470-770 MHz in digital terrestrial broadcasting), are required to have high gain in such wide frequency bands, and small sizes with low height. As a small antenna suitable for such mobile communications apparatuses, JP 49-40046 A proposes an antenna which is made smaller by using a magnetic material having large dielectric constant $\in r$ and specific permeability $\mu r$ to reduce wavelength to $1/(\in r \cdot \mu r)^{1/2}$, and JP 9-507828 A describes that sintered hexagonal ferrite is suitable for antennas. Hexagonal ferrite is a magnetic material having an easy magnetization axis in a plane perpendicular to a c-axis, which may be called "ferrox planar type ferrite."

JP 56-64502 A discloses a dipole-type antenna comprising a conductor pattern embedded in a Ni ferrite substrate. However, even a ferrite-made antenna cannot be sufficiently small and operable in a wide band, unless having a structure effectively providing inductance while suppressing a capacitance component.

OBJECT OF THE INVENTION

Accordingly, an object of the present invention is to provide a small chip antenna suitable for communications apparatuses operable in wide frequency bands, its production method, and an antenna apparatus and a communications apparatus comprising such chip antenna.

DISCLOSURE OF THE INVENTION

The first chip antenna of the present invention comprises a magnetic substrate comprising Z-type ferrite or Y-type ferrite as a main phase and having a through-hole extending linearly along a center axis, and a conductor penetrating the through-hole, the magnetic phase having a c-axis substantially parallel to the through-hole.

The second chip antenna of the present invention comprises a magnetic substrate comprising Z-type ferrite or Y-type ferrite as a main phase and a through-hole extending linearly along a center axis, and a conductor penetrating the through-hole, the magnetic phase having a c-axis substantially perpendicular to the through-hole.

Each of the first and second chip antennas is small and operable in a wide band, because the conductor penetrating the linear through-hole does not have portions opposing to each other, so that a magnetic body can effectively function as inductance. Because the c-axis (difficult magnetization axis) of Z-type ferrite or Y-type ferrite is oriented substantially parallel or perpendicular to the through-hole, initial permeability is aligned in a circumferential direction around the linear through-hole. Accordingly, a magnetic field generated by the linear conductor can be utilized efficiently, making it possible to miniaturize the antenna.

In the first and second chip antennas, the orientation of the c-axis of a magnetic phase in a magnetic substrate is represented by a peak intensity ratio Rx in an X-ray diffraction pattern of a cross section perpendicular to the through-hole, a peak intensity ratio Ry in an X-ray diffraction pattern of a longitudinal cross section including a center axis of the through-hole, and a peak intensity ratio Rz in an X-ray diffraction pattern of a cross section at a predetermined depth in parallel to a longitudinal cross section including a center axis of the through-hole. All of the peak intensity ratios Rx, Ry and Rz are expressed by I(1016)/I(0018) in the case of Z-type ferrite, and I(110)/I(0015) in the case of Y-type ferrite.

In the first chip antenna of the present invention, the c-axis of a magnetic phase in a magnetic substrate is substantially parallel to the through-hole. This structure provides high permeability in a circumferential direction of the through-hole. The term "substantially parallel" used herein means that 60% or more of the c-axis exists within a range of ±45° relative to a parallel line of the through-hole. The distribution of the c-axis is determined by orientation analysis using EBSP (electron back-scattering pattern). First, the orientation analysis of each crystal grain is conducted in a region containing 50 or more crystal grains, using a beam diameter 1/10 or less of the average crystal grain size of the sintered body. The difference between a direction parallel to the through-hole of the magnetic substrate and the c-axis direction of each crystal grain is calculated, and the number A of crystal grains having the difference of 45° or less and the number B of crystal grains having the difference of more than 45° were used to calculate A/(A+B) as the above ratio.

A ratio Rz/Rx at depth of 0.3 mm is preferably 1.5 or more. A magnetic substrate meeting such condition can be formed by pressing, particularly wet pressing in a magnetic field.

In the second chip antenna of the present invention, the c-axis of a magnetic phase in a magnetic substrate is substantially perpendicular to the through-hole. This structure provides high permeability in a circumferential direction of the through-hole. The term "substantially perpendicular to" used herein means that 60% or more of the c-axis exists within a range of ±45° relative to a line perpendicular to the through-hole. Like above, this ratio is determined by conducting the orientation analysis of each crystal grain by EBSP in a region containing 50 or more crystal grains, calculating the difference between a direction perpendicular to the through-hole and the c-axis direction of each crystal grain, and obtaining the number A' of crystal grains having the difference of 45° or less and the number B' of crystal grains having the difference of more than 45° to calculate A'/(A'+B').

Rz is preferably 1.6 or less at depth of 0.3 mm, more preferably 1.4 or less at depth of 0.6 mm. Ry is preferably 2.0 or more. A ratio Rz/Rx at depth of 0.3 mm is preferably 0.45 or less. A ratio Rz/Ry at depth of 0.3 mm is preferably 0.8 or less. Thus, the orientation of the c-axis of a magnetic phase is more aligned on a surface side than a through-hole side.

Accordingly, it is preferable to use a magnetic substrate with an as-sintered outer surface (without surface working). The magnetic substrate with such feature can be formed by extrusion.

Conductors in pluralities of chip antennas may be connected in series to constitute a chip antenna assembly. With series-connected conductors bent, the arrangement of pluralities of magnetic substrates can be changed according to a mounting space. Thus, the antennas can be assembled in communications apparatuses, etc. with high space efficiency. Further, because individual magnetic substrates can be made shorter relative to chip antenna length necessary for antenna characteristics, the shock resistance of the entire chip antenna is increased.

The antenna apparatus of the present invention comprises the above chip antenna, the conductor having one open end and the other end portion connected to a feed circuit. Because a chip antenna with small capacitance is used, wide-band antenna apparatuses can be obtained.

The communications apparatus of the present invention comprises the above antenna apparatus. Because the above antenna apparatus functions in a wide band, the communications apparatus comprising it can also be used in a wide band. The above antenna apparatus is suitable for portable terminals for digital terrestrial broadcasting, cell phones, etc., contributing to miniaturization and the improvement of reliability.

BRIEF DESCRIPTION OF THE DRAWINGS

FIG. 2(*b*) is an exploded cross-sectional view showing the chip antenna of FIG. 2(*a*).

FIG. 5(*b*) is a cross-sectional view taken along the line A-A in FIG. 5(*a*).

FIG. 6(*b*) is a cross-sectional view taken along the line B-B in FIG. 6(*a*).

FIG. 8(*b*) is an exploded cross-sectional view showing the die of FIG. 8(*a*).

FIG. 9(*b*) is a side view showing the antenna apparatus of FIG. 9(*a*).

FIG. 10(*b*) is a view showing another example of matching circuits used in the antenna apparatus of the present invention.

FIG. 11(*b*) is a front view showing the cell phone of FIG. 11(*a*).

DESCRIPTION OF THE PREFERRED EMBODIMENTS

[1] Ferrite

Figure 1:
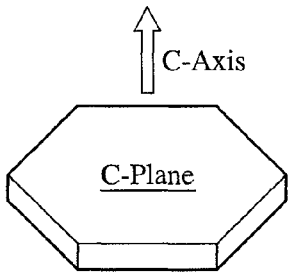
FIG. 1 is a perspective view showing the orientation of hexagonal ferrite crystal grains.

Any of Z-type ferrite and Y-type ferrite forming a main phase of the magnetic substrate is anisotropic, soft-magnetic ferrite whose c-plane is an easy magnetization plane. As shown in FIG. 1, Z-type ferrite and Y-type ferrite have a planar, hexagonal structure, whose c-axis in a difficult magnetization direction is perpendicular to a planar surface (c-plane in an easy magnetization direction). Because Y-type ferrite has high permeability in as high a frequency band as 1 GHz or higher, and small magnetic loss in a frequency band up to 1 GHz, it is suitable for applications in frequency bands higher than 400 MHz, for instance, chip antennas for digital terrestrial broadcasting in a frequency band of 470-770 MHz. Z-type ferrite has high permeability, despite poorer frequency characteristics of permeability than those of Y-type ferrite. Because of a small loss coefficient at 400 MHz or less, Z-type ferrite is suitable for applications used in a frequency band of 400 MHz or less. Z-type ferrite is typically represented by the chemical formula of $Ba_3CO_2Fe_{24}O_{41}$ (so-called $CO_2Z$), and Y-type ferrite is typically represented by the chemical formula of $Ba_2CO_2Fe_{12}O_{22}$ (so-called $CO_2Y$), both being hexagonal soft ferrite. Part of Ba may be substituted by Sr, and part of Co may be substituted by a bivalent metal such as Ni, Cu, Zn, etc. Further, an oxide of Si, Li, Na, Mn, etc. may be added. Although a lower dielectric constant is preferable for loss reduction, ferrite having a dielectric constant of 8 or more, particularly 10 or more can be used because the internal loss of an antenna having the structure of the present invention is less affected by the dielectric constant.

The structure of the magnetic substrate comprises Z-type ferrite or Y-type ferrite as a main phase, a main peak of Z-type ferrite or Y-type ferrite having the maximum intensity in an X-ray diffraction pattern. Z-type ferrite or Y-type ferrite preferably has a single phase, but it may contain their mixed phase, and it may contain other ferrite phases such as W-type ferrite, etc. However, a percentage of one ferrite phase contained in the other ferrite phase is preferably within 20%. For instance, when the Z-type ferrite is a main phase, the Y-type ferrite may be contained within 20%.

[2] Chip Antenna

Figure 2A:
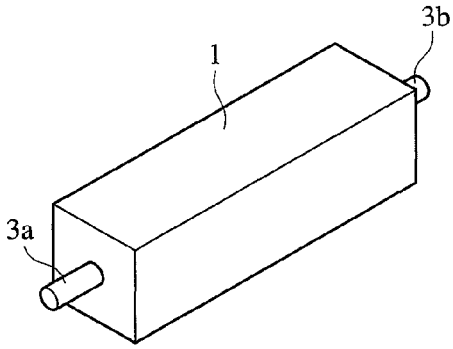
FIG. 2(*a*) is a perspective view showing the chip antenna of the present invention.
Figure 2B:
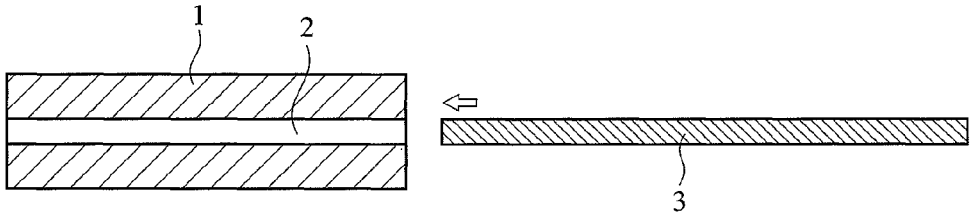

FIGS. 2(*a*) and 2(*b*) show one example of the chip antennas of the present invention. This chip antenna comprises a rectangular magnetic substrate 1 having a through-hole 2 extending along a center axis, and a linear conductor 3 penetrating the through-hole 2. Although the depicted magnetic substrate 1 is a rectangular parallelepiped, it may be a cylinder. Although the depicted through-hole 2 (conductor 3) has a circular cross section, it may have a rectangular cross section. To provide good antenna characteristics and low height, a ratio of the length to the width and height (diameter in the case of a cylinder) is preferably 3 or more. When pluralities of magnetic substrates are laminated, the resultant laminate need only to meet the above requirement.

Figure 3:
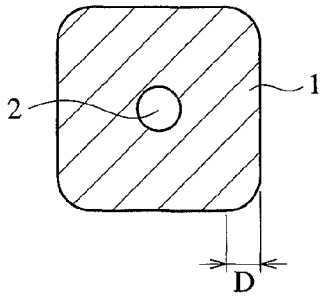
FIG. 3 is a cross-sectional view showing the shape of a magnetic substrate used in the chip antenna according to one embodiment of the present invention.

For safe mounting, the magnetic substrate 1 is preferably rectangular, but it may be cylindrical. In the case of a rectangular magnetic substrate, its four corners can be chamfered as shown in FIG. 3 to improve the orientation of planar ferrite crystals, suppressing the leak of a magnetic flux, and preventing problems such as chipping, etc. A chamfer may be a curved or flat surface, but the curved surface is preferable. The chamfer preferably has width D of 0.2-1 mm. The width D of the chamfer is preferably ⅓ or less of the width or height of the magnetic substrate 1. Because chamfering by barrel grinding, etc. removes the oriented surface layer, extrusion in a chamfered shape is preferable.

With increased length, width and height, the magnetic substrate 1 has a reduced resonance frequency, but it makes a chip antenna too large. The magnetic substrate 1 preferably has a length of 30 mm or less, a width of 10 mm or less, and a height of 5 mm or less. For instance, when used in a digital terrestrial broadcasting band (470-770 MHz), the magnetic substrate 1 preferably has a length of 25-30 mm, a width of 3-5 mm, and a height of 3-5 mm. In the case of a chip antenna assembly, pluralities of magnetic substrates 1 may have a total length of 25-30 mm.

Each end portion 3*a*, 3*b* of the conductor 3, which functions as a radiation conductor, extends from each end surface of the magnetic substrate 1. Because only one conductor 3 with no opposing portions exists in the magnetic substrate 1, the antenna has extremely small capacitance. With the conductor 3 penetrating the magnetic substrate 1, a chip antenna is made small, with high freedom of design in the connection of both ends 3*a*, 3*b* of the conductor 3 to other circuit elements. A gap between the linear conductor 3 and an outer surface of the rectangular magnetic substrate 1 is preferably substantially constant in a longitudinal direction. The conductor 3 may be bonded to the magnetic substrate 1 with an adhesive, etc.

To be operable in a wider band, the Q value of the antenna should be reduced. Because the Q value is expressed by $(C/L)^{1/2}$, wherein L represents inductance, and C represents capacitance, L should be increased, while C should be reduced. For instance, when a dielectric material is used for the substrate, the conductor should have a larger number of turns to increase the inductance L, but it does not increase the Q value effectively because the increased number of turns results in increased capacitance between wires. On the other hand, in the chip antenna of the present invention having a linear conductor penetrating a magnetic substrate 1, the inductance L depends on the length, cross section area and permeability of the magnetic substrate 1, making it possible to increase the inductance L efficiently by high-permeability crystal orientation. Thus, the Q value can be reduced without suffering capacitance between wires. Because a circumferential magnetic flux generated from the conductor 3 does not leak from the magnetic substrate 1, the chip antenna of the present invention has a closed magnetic path.

The conductor 3 is preferably made of Cu, Ag, Ni, Pt, Au, Al, 42-Alloy, Kovar, phosphor bronze, brass, Corson series copper alloys, etc. Soft metals such as Cu are suitable when both ends of the conductor 3 are bent. High-hardness metals such as 42-Alloy, Kovar, phosphor bronze, Corson series copper alloys, etc. are suitable when the conductor 3 is used without bending. The conductor 3 may have an insulating coating of polyurethane, enamel, etc.

Figure 4:
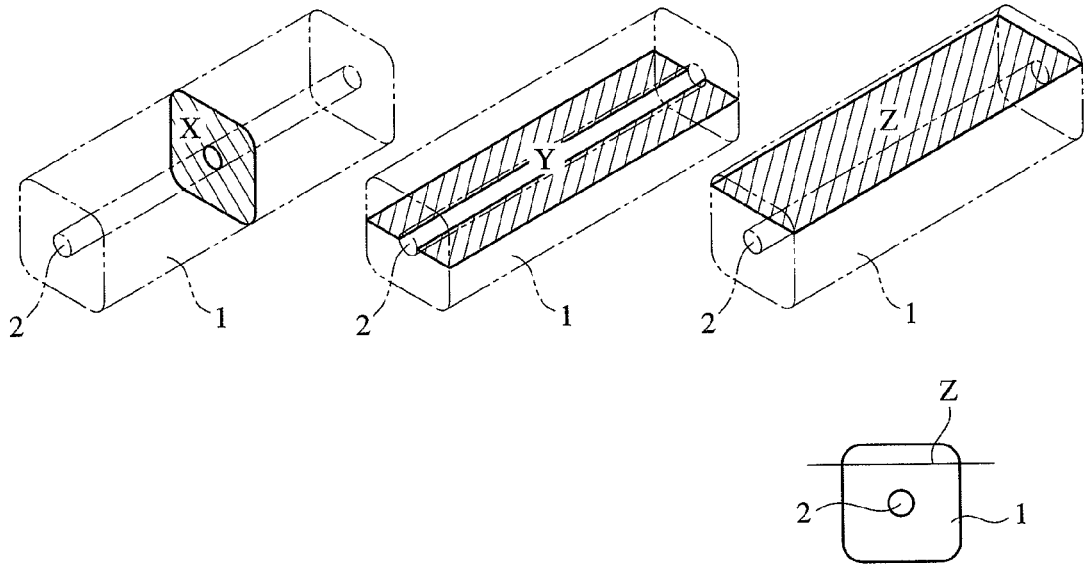
FIG. 4 is a schematic view showing the cross sections X, Y and Z of the magnetic substrate.

When the initial permeability (c-plane) of crystal grains of Z-type ferrite or Y-type ferrite is aligned with the same circumferential direction as a magnetic flux generated from the conductor 3, the magnetic substrate 1 has high permeability. To orient the c-plane in a circumferential direction, (a) the c-plane exists in a transverse cross section X perpendicular to the through-hole 2, or (b) the c-plane exists in a longitudinal cross section Z not including the through-hole 2, which is perpendicular to the transverse cross section X. A longitudinal cross section Y including the through-hole 2 is obtained when the cross section Z reaches the center axis of the through-hole 2. The cross section X, Y and Z are shown in FIG. 4.

(1) First Magnetic Substrate

Figure 5A:
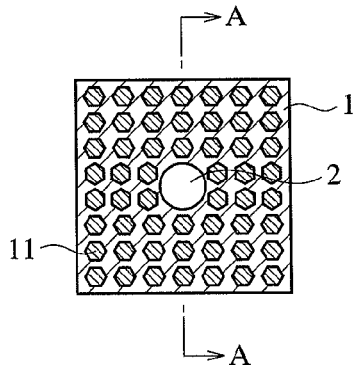
FIG. 5(*a*) is a transverse cross-sectional view showing the orientation of hexagonal ferrite crystal grains in the first magnetic substrate.
Figure 5B:
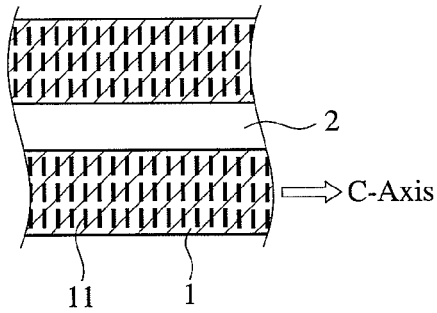

FIGS. 5(*a*) and 5(*b*) show the orientation of hexagonal ferrite crystal grains 11 in the magnetic substrate 1 in the case of (a) above. The c-axes of the hexagonal ferrite crystal grains 11 are oriented substantially in parallel to the through-hole 2, so that the c-planes are aligned in the transverse cross section X. The c-axes need not be completely parallel to the through-hole 2, but 60% or more of the c-axes may be within a range of ±45° to the center axis of the through-hole 2. With this orientation, high permeability is obtained in a circumferential direction around the through-hole 2 as a center axis. The first magnetic substrate is obtained by pressing, preferably by wet pressing in a magnetic field.

The orientation of the c-axes is determined from intensity ratios Rx, Ry and Rz of diffraction peaks of c-planes to the other largest-intensity diffraction peaks, in an X-ray diffraction pattern of a transverse cross section X, in an X-ray diffraction pattern of a longitudinal cross section Y including the center axis of the through-hole 2, and in an X-ray diffraction pattern of a longitudinal cross section Z not including the through-hole 2. The intensity ratio Rx, Ry, Rz in each cross section X, Y, Z is a ratio of I(1016)/I(0018) in the case of Z-type ferrite, wherein I(1016) is a peak intensity of a (1016) plane, and I(0018) is a peak intensity of a (0018) plane, and a ratio of I(110)/I(0015) in the case of Y-type ferrite, wherein I(110) is a peak intensity of a (110) plane, and I(0015) is a peak intensity of a (0015) plane. The comparison of Rx, Ry and Rz in the cross sections X, Y and Z indicates that the c-axes are oriented in a longitudinal direction when Rx is smaller than Ry and Rz. Rx is preferably 1.8 or less, more preferably 1.7 or less. Ry and Rz are preferably 3 or more.

(2) Second Magnetic Substrate

Figure 6A:
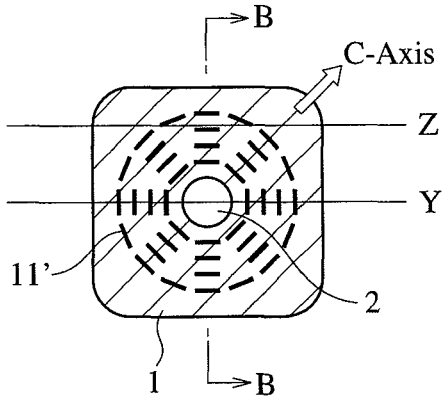
FIG. 6(*a*) is a transverse cross-sectional view showing the orientation of hexagonal ferrite crystal grains in the second magnetic substrate.
Figure 6B:
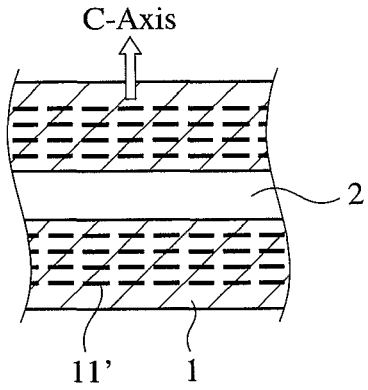

FIGS. 6(*a*) and 6(*b*) show the orientation of hexagonal ferrite crystal grains 11' in the magnetic substrate 1 in the case of (b) above. As shown in FIG. 6(*a*), the c-axes of the crystal grains 11' are oriented substantially perpendicularly to the through-hole 2 (radially from the through-hole 2), and the c-planes are oriented substantially in parallel to the through-hole 2 along a circumferential direction around the through-hole 2. Accordingly, high permeability is obtained in a circumferential direction around the through-hole 2. With this orientation, high permeability is also obtained in the longitudinal direction of the through-hole 2. The c-axes need not be completely perpendicular to the through-hole 2, but 60% or more of the c-axes need only be within a range of ±45° to a line perpendicular to the through-hole 2.

The second magnetic substrate is formed by an extrusion method. The c-axes of planar crystal grains 11' of Z-type ferrite or Y-type ferrite are oriented perpendicularly to the extrusion direction by a shearing force during extrusion. Because the shearing force is larger in a surface portion of the moldable material than in its center portion, the radial orientation of the c-axes is higher on the surface side of an extrudate, decreases as nearing the through-hole, and becomes high at the through-hole. Namely, the orientation of the c-axes is lowest in the middle between a magnetic substrate surface and the through-hole surface, and highest at the magnetic substrate surface and the through-hole surface. Because the magnetic substrate surface has high c-axis orientation, the sintered surface of the magnetic substrate 1 is preferably not removed.

In the case of the orientation shown in FIG. 6, Rz in a cross section Z in parallel to a longitudinal cross section Y including the center axis of the through-hole 2 at depth not reaching the through-hole 2 is preferably 1.6 or less, more preferably 1.4 or less, at depth of 0.3 mm. Rz is preferably 1.6 or less, more preferably 1.4 or less, at depth of 0.6 mm. This means that planar ferrite crystals are well oriented in the magnetic substrate 1 up to a substantially intermediate depth between the outer surface and the through-hole 2. Ry (equal to Rz) in a cross section Y at the depth of the center of the through-hole 2 is preferably 2.0 or more. Rx in a transverse cross section X perpendicular to the through-hole 2 is preferably 3.5 or more. Accordingly, Rz is smaller than Rx and Ry. The definition of the cross sections X, Y and Z is shown in FIG. 4.

[3] Chip Antenna Assembly

Figure 7:
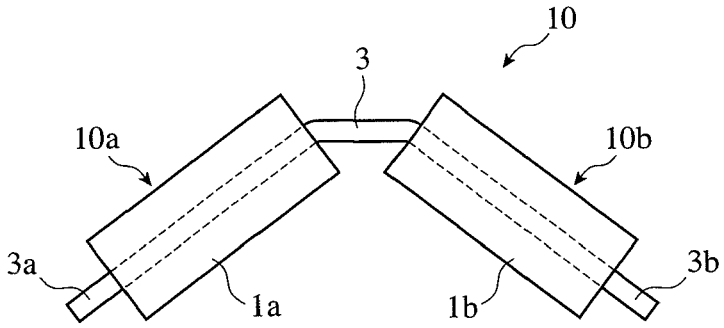
FIG. 7 is a plan view showing the chip antenna assembly of the present invention.

FIG. 7 shows one example of the chip antenna assemblies of the present invention. This chip antenna assembly 10 comprises two chip antennas 10*a*, 10*b*, but three or more chip antennas may be connected. Each chip antenna comprises a magnetic substrate 1 and a linear conductor 3. In the example shown in FIG. 7, magnetic substrates 1*a* and 1*b* are separated. Both chip antennas 10*a*, 10*b* are connected with one conductor 3, but they may have separate conductors, which are connected in series via a connecting conductor. The chip antenna assembly 10 may be regarded as having a structure in which a magnetic substrate of a chip antenna is divided to two. This structure makes it possible to change the arrangement of the magnetic substrates according to a mounting space. Because individual magnetic substrates are short, the overall chip antenna has high mechanical strength and thus improved reliability. The chip antenna assembly 10 exhibits the same antenna characteristics as those of an integral chip antenna.

In the chip antenna assembly 10 shown in FIG. 7, a end portion 3*a* of a conductor 3 in one chip antenna 10*a* is an open end, while an end portion 3*b* of a conductor 3 in the other chip antenna 10*b* is connected to a feed circuit. In this respect, the chip antenna assembly 10 differs from conventional dipole antennas.

[4] Production Method of Chip Antenna

A pressing or extrusion method is used for the production of the magnetic substrate. The pressing method is suitable for producing the first magnetic substrate, and the extrusion method is suitable for producing the second magnetic substrate. In any case, starting material powders of $Fe_2O_3$, $BaCO_3$, $CO_3O_4$, etc. are wet-mixed for 4-20 hours, for instance, and the mixed powder is calcined and wet-pulverized to form calcined powder. The pressing method preferably use sintered powder, which is formed by mixing the calcined powder with a binder such as PVA, and granulating it by a spray drier, etc. to obtain the granulated powder, which is sintered and then pulverized again. Because the sintered powder contains a high percentage of single-crystal, hexagonal ferrite particles, high orientation is obtained. The pulverized, sintered hexagonal ferrite preferably has an average crystal grain size of 5-200 μm. However, the extrusion method can use the calcined powder in the form of a moldable material.

(1) Pressing Method

The sintered powder is pressed in a magnetic field. The magnetic field during pressing is preferably a rotating magnetic field or an alternating magnetic field whose direction changes in the same plane. Alternatively, a molding space may be rotated in a constant-direction magnetic field. Preferable to improve orientation is wet pressing using an aqueous slurry of the sintered powder. A binder such as methylcellulose, etc. may be added to the slurry. The pressing method in a magnetic field can produce sintered hexagonal ferrite in-plane oriented as shown in FIG. 5. A green body is sintered in an electric furnace, etc., and then machined, if necessary. When the magnetic substrate 1 has a large ratio of length to width and height (diameter in the case of a cylindrical body), the pressing method cannot easily produce an integral magnetic substrate. Accordingly, pluralities of sintered ferrite bodies may be connected.

(2) Extrusion Method

Figure 8A:
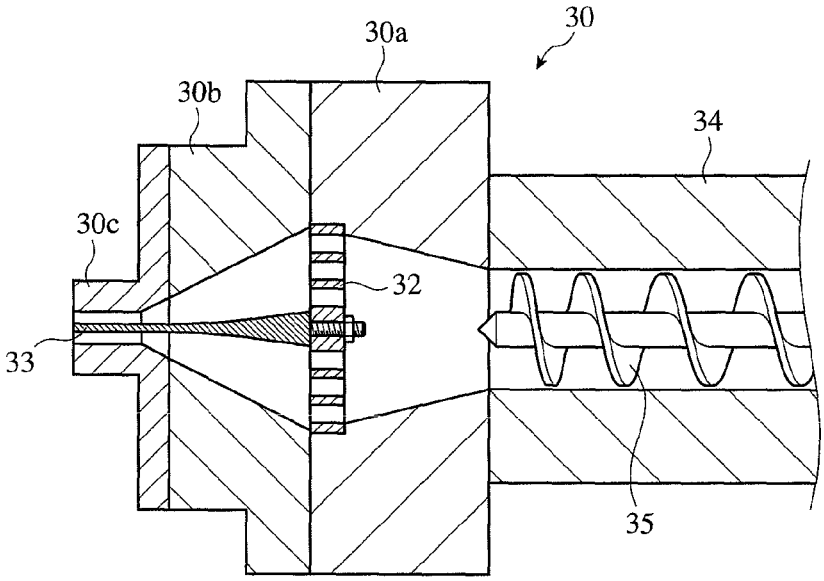
FIG. 8(*a*) is a cross-sectional view showing a die for extruding the magnetic substrate.
Figure 8B:
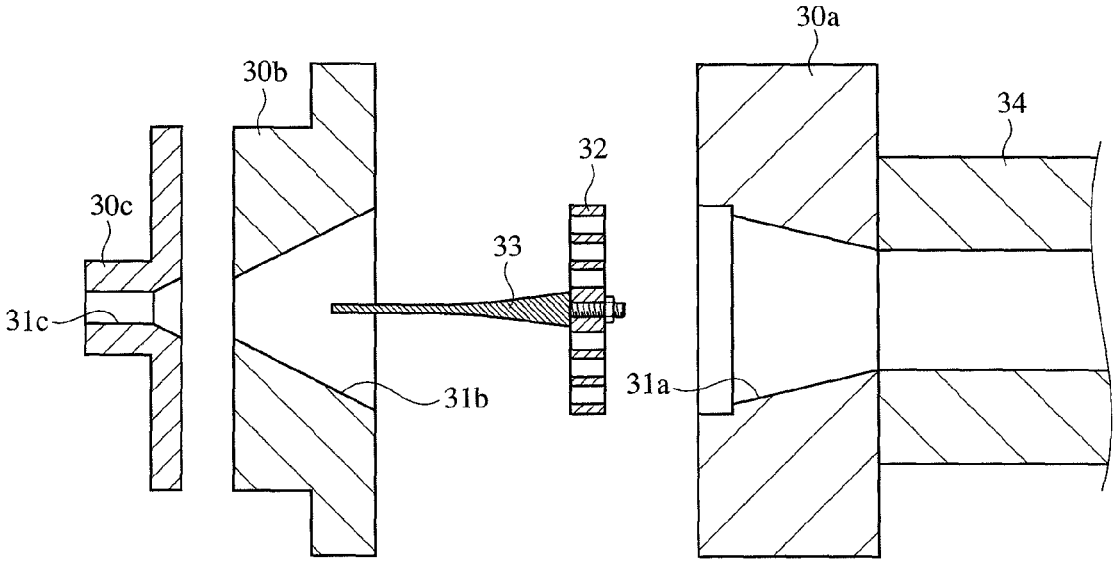

The sintered powder is mixed with water, a binder, a plasticizer and a lubricant to form a moldable material, which is extruded through, for instance, a die 30 having the structure shown in FIG. 8. The die 30 comprises first to third blocks 30*a*, 30*b*, 30*c* communicating with an extruder 34 having a screw 35. The first block 30*a* has a diameter-increasing, conical inner surface 31*a*, and a recess at an external end, in which a plate 32 for rectifying a moldable material is received. Fixed to a center of the rectifying plate 32 is a center rod 33 for forming a through-hole 2. The second block 30*b* has a tapered, conical inner surface 31*b*, whose inner end has the same inner diameter as that of the outer end of the conical inner surface 31*a* of the first block 30*a*. The third block 30*c* has a rectangular inner surface 31*c* having a conical inner surface portion having the same inner diameter as that of the conical inner surface 31*b* of the second block 30*b*. Thus, the inner surface 31*c* is conical in an upstream portion and rectangular in the other portion. The center rod 33 extends through the third block 30*c* to outside. The inner surfaces 31*a*, 31*b*, 31*c* of the first to third blocks 30*a*, 30*b*, 30*c* define a cavity whose diameter increases to that of the rectifying plate 32 and then decreases. Because of a cavity whose diameter decreases along the extrusion direction downstream of the rectifying plate 32, the c-planes of the planar crystal grains in the moldable material are oriented along each side of the cavity while passing through the die 30. The resultant extrudate is dried and then cut to a predetermined length. A magnetic field may be applied during extrusion.

The moldable material should have fluidity (consistency) ensuring self-supportability sufficient for easily orienting planar crystal grains and keeping an extrudate shape. Because the fluidity of a moldable material comprising Z-type ferrite or Y-type ferrite is largely influenced by the water content, the water content is preferably 13-15% by mass based on the moldable material.

[5] Antenna Apparatus

Figure 9A:
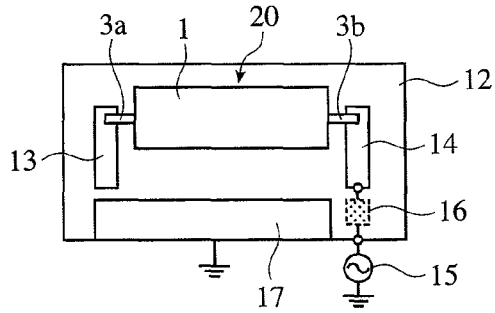
FIG. 9(*a*) is a plan view showing one example of the antenna apparatuses of the present invention.
Figure 9B:
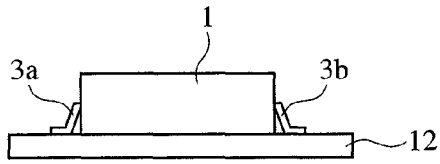

FIGS. 9(*a*) and 9(*b*) show one example of antenna apparatuses, which comprises a chip antenna 20 mounted onto a circuit of a board 12, both end portions 3*a*, 3*b* of a linear conductor 3 penetrating a through-hole 2 of a magnetic substrate 1 extending from the chip antenna 20. Both end portions 3*a*, 3*b* of the conductor 3 are bent outside the magnetic substrate 1, one end portion 3*a* (open end) being soldered to a fixing electrode 13 extending perpendicularly to the conductor 3, and the other end portion 3*b* being soldered to a feed electrode 14, which is connected to a feed circuit 15 via a matching circuit 16. Accordingly, an electrode need not be formed on the magnetic substrate 1, thereby preventing the generation of a capacitance component. In the example shown in FIG. 9, the chip antenna 20, the fixing electrode 13, the ground electrode 17 and the feed electrode 14 are in a U-shaped arrangement. Because an end portion of the fixing electrode 13 is opposing the ground electrode 17 with a predetermined gap, the adjustment of antenna characteristics can be achieved by a capacitance component therebetween.

Figure 10A:
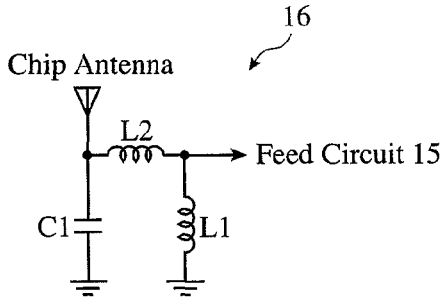
FIG. 10(*a*) is a view showing one example of matching circuits used in the antenna apparatus of the present invention.
Figure 10B:
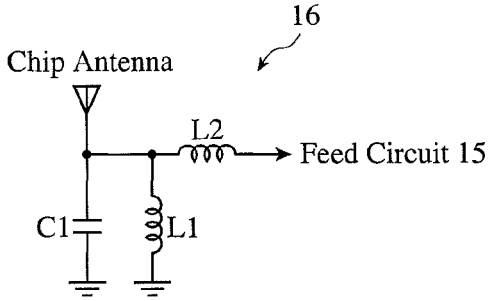

The use of the chip antenna of the present invention provides an antenna apparatus having a wide operating frequency band. The average gain of the antenna apparatus is preferably −7 dBi or more, more preferably −5 dBi or more. As shown in FIGS. 9(*a*) and 9(*b*), pluralities of matching circuits 16 are disposed between the chip antenna 20 and the feed circuit 15 to adjust the resonance frequency of the antenna apparatus, and their switching for shifting the resonance frequency of the antenna apparatus may be used to change the operating band. Thus, an impedance-matching circuit has a function of adjusting the resonance frequency of the antenna apparatus. The matching circuit 16 shown in FIG. 10(*a*) comprises a capacitor C1 and an inductor L1 both grounded, and an inductor L2 connected therebetween. The capacitor C1 is connected to the conductor of the chip antenna 20, and the inductor L2 is connected to the feed circuit 15. Pluralities of matching circuits comprising inductors L2 having different inductances are disposed for switching. In one of the matching circuits, the inductor L2 may have zero inductance.

To provide the antenna apparatus with a small size and low loss, the matching circuits 16 are preferably switched by semiconductor switches or diodes. By switching pluralities of matching circuits 16, one antenna apparatus is adaptable to different bands. Instead of switching the matching circuits 16, only particular circuit devices such as inductors L2, etc. may be switched. The switching of the matching circuits 16 provides −7 dBi or more, preferably −5 dBi or more, in a frequency band of 470-770 MHz, making the antenna apparatus suitable for digital terrestrial broadcasting.

Figure 11A:
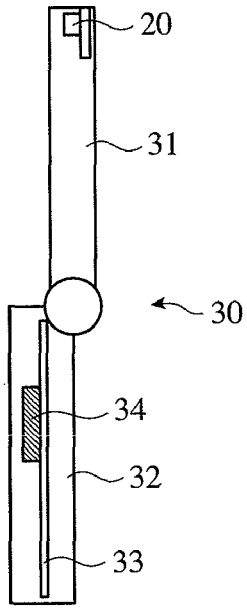
FIG. 11(*a*) is a cross-sectional view showing one example of cell phones comprising the chip antenna of the present invention.
Figure 11B:
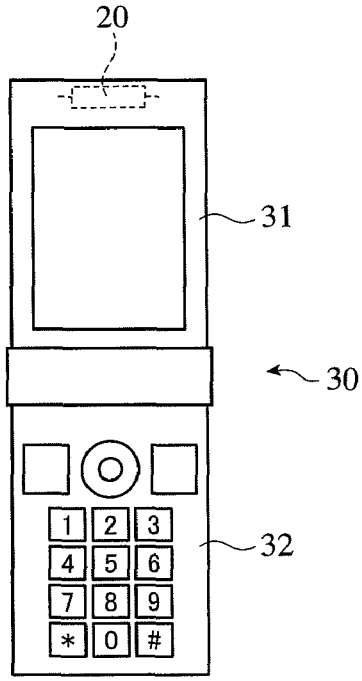

The antenna apparatus comprising the chip antenna of the present invention can be used for communications apparatuses, such as cell phones, wireless LAN, personal computers, digital terrestrial broadcasting equipments, etc. Because digital terrestrial broadcasting uses a wide frequency band, the antenna apparatus of the present invention is particularly suitable. The antenna apparatus of the present invention can reduce mounting area and space. FIGS. 11(*a*) and 11(*b*) show an example of cell phones comprising the antenna apparatus. In FIG. 11(*b*), the chip antenna 20 is shown by a dotted line. In the cell phone 30, the chip antenna 20 is disposed near an upper end of a display unit 31, and connected to a wireless module 34 attached to a board 33 of an operating unit 32. The chip antenna 20 is not restricted to this arrangement, but may be disposed in the operating unit 32.

The present invention will be explained in further detail by Examples below without intention of restricting the present invention thereto.

EXAMPLE 1

100 parts by mass of main components comprising $Fe_2O_3$, $BaCO_3$ and $CO_3O_4$ in such proportions that $Fe_2O_3$ was 70.2% by mol, BaO was 18.8% by mol, and CoO was 11.0% by mol were mixed with 3.0 parts by mass of $Mn_3O_4$, 0.4 parts by mass of $Li_2CO_3$ and 0.13 parts by mass of $SiO_2$ for 16 hours by wet ball milling, and calcined at 1200° C. for 2 hours in the air. The calcined powder was pulverized for 18 hours by wet ball milling, and then granulated with a binder (PVA). The granulated powder was sintered at 1300° C. for 3 hours in the air. The sintered body was pulverized a jaw crusher, a disc mill and a vibration mill. The resultant sintered powder had a specific surface area of 10800 $cm^2/g$ (measured by a BET method using Model-1201 available from Macsorb).

Pure water was added to the sintered powder to prepare slurry having a concentration of 75% by mass, which was wet-molded to a ring shape (Sample 1) and a rectangular shape (Sample 2) under pressure of 25 MPa while applying a rotating magnetic field of 0.48 MA/m in a direction perpendicular to the pressing direction. Each of the resultant green bodies was sintered at 1310° C. for 3 hours to form a ring-shaped, sintered body (Sample 1) having an outer diameter of 6.8 mm, an inner diameter of 3.2 mm and a height of 1.5 mm The sintered body of Sample 1 was measured with respect to density by a water substitution method, and initial permeability $\mu_i$ and a loss coefficient tan δ at 25° C. and 1 GHz by an impedance gain phase analyzer (4291B available from Yokogawa Hewlett Packard). As a result, the density was 4.57 $g/cm^3$, the initial permeability $\mu_i$ was 23.4, and the loss coefficient tan δ was 1.15.

X-ray diffraction revealed that a main phase of Sample 1 was Z-type ferrite whose main peak was (1016). In the X-ray diffraction pattern of a plane X in parallel to the rotating magnetic field, a ratio of I(1016)/I(0018), wherein I(1016) was the intensity of a peak (1016), and I(0018) was the intensity of a peak (0018), was 0.10. In the X-ray diffraction patterns of planes Y and Z perpendicular to the rotating magnetic field, both of their ratios I(1016)/I(0018) were 0.69. This indicates that the plane X was an easy magnetization surface (c-plane). It is clear that the initial permeability $\mu_i$ increased by this plane orientation.

EXAMPLE 2

100 parts by mass of main components comprising $Fe_2O_3$, $BaCO_3$ and $CO_3O_4$ in such proportions that $Fe_2O_3$ was 60% by mol, BaO was 19.5% by mol, and CoO was 20.5% by mol were mixed with 0.6 parts by mass of CuO for 16 hours by wet ball milling with water as a medium. The mixed powder was dried, and then calcined at 1000° C. for 2 hours in the air. The calcined powder was pulverized for 18 hours by wet ball milling with water as a medium. 100 parts by mass of the resultant powder was mixed with 1% by mass of binder (PVA) for granulation, and pressed to a ring shape. The resultant green body was sintered at 1200° C. for 3 hours in the air to form a ring-shaped, sintered body (Sample 2) having an outer diameter of 7.0 mm, an inner diameter of 3.5 mm and a height of 3.0 mm, and a rectangular sintered body (Sample 3) of 10 mm×3 mm×3 mm having a through-hole having a circular cross section of 0.6 mm in diameter along a center axis. X-ray diffraction revealed that the main phase of the sintered body was Y-type ferrite whose main peak was (110).

EXAMPLE 3

100 parts by mass of main components comprising $Fe_2O_3$, $BaCO_3$ and $CO_3O_4$ in such proportions that $Fe_2O_3$ was 60% by mol, BaO was 19.5% by mol, and CoO was 20.5% by mol were mixed with 0.6 parts by mass of CuO by wet ball milling with water as a medium. The mixed powder was dried, and then calcined at 1100° C. for 1.5 hours in the air. The calcined powder was pulverized for 10 hours by wet ball milling with water as a medium, and mixed with water, a binder, a lubricant and a plasticizer to prepare a moldable material having a water content of 13.8% by mass. Using a die shown in FIG. 8, the moldable material was extruded, dried, and sintered at 1150° C. for 3 hours in the air to form a rectangular sintered body (Sample 4) of 10 mm×3 mm×3 mm having a through-hole having a circular cross section of 0.6 mm in diameter along a center axis, and a chamfered curve surface of 0.5 mm in width at each corner. X-ray diffraction revealed that the main phase of the sintered body was Y-type ferrite whose main peak was (110).

Samples 3 and 4 were measured with respect to permeability, inductance and Rx, Ry and Rz by the following methods. The results are shown in Table 1.

(1) Permeability

With one conductor penetrating the through-hole, the permeability of each sample was measured at 25° C. and 100 kHz in a circumferential direction from the through-hole as a center axis.

(2) Inductance

With 10 turns of a wire wound around each sample, the inductance of each sample was measured at 25° C. and 100 kHz in an axial direction. Using the inductance in an axial direction, the permeability of the through-hole in an axial direction can be evaluated.

(3) Rx, Ry and Rz

In X-ray diffraction patterns measured on the cross sections X, Y and Z (shown in FIG. 4) of each sample, the intensity ratios I(110)/I(0015) were determined as Rx, Ry and Rz from peaks (110) and (0015) of the Y-type ferrite. The cross section Z was obtained at depth of 0.3 mm from the surface.

TABLE 1

| Sample | Production Method | Initial Permeability $\mu_i$ (1) | Inductance (2) |
|---|---|---|---|
| 3 | Pressing | 2.0 | 344 |
| 4 | Extrusion | 2.1 | 364 |

| Sample | Rx | Ry | Rz | Rz/Rx | Rz/Ry |
|---|---|---|---|---|---|
| 3 | 1.66 | 2.72 | 2.92 | 1.8 | — |
| 4 | 5.21 | 2.01 | 1.51 | 0.3 | 0.75 |

Note:
(1) Initial permeability in a circumferential direction at 25° C. and 100 kHz.
(2) Inductance (unit: nH) in an axial direction at 25° C. and 100 kHz.

In Sample 3 obtained by pressing, Ry and Rz were substantially the same, and Rx was 0.7 times or less as small as Ry and Rz. In Sample 4 obtained by extrusion, Rz was smaller than Rx and Ry. In Sample 4, large Rx was obtained by the alignment of the c-planes in the extrusion direction, and extremely small Rz was obtained by the orientation of the c-axes in perpendicular to the through-hole. Particularly, Rz/Rx was as small as 0.3, and Rz/Ry was as small as 0.75. Accordingly, as shown in FIG. 6(*a*), the c-planes were oriented in a direction circulating around the through-hole as a center axis. Because this orientation increases permeability in a circumferential direction around the through-hole as a center axis, it is suitable for a chip antenna using that direction as a magnetic path. As shown in Table 1, the initial permeability $\mu_i$ of Sample 4 in a circumferential direction was 5% higher than that of Sample 3 obtained by pressing. The fact that orientation can be obtained by pressing emphasizes what excellent permeability Sample 4 oriented by extrusion had. With respect to inductance along the through-hole, too, Sample 4 was 6% higher than Sample 3. Sample 4 with improved permeability in circumferential and axial directions of the through-hole can make chip antennas smaller.

EXAMPLE 4

100 parts by mass of main components comprising $Fe_2O_3$, $BaCO_3$ and $CO_3O_4$ in such proportions that $Fe_2O_3$ was 60% by mol, BaO was 19.5% by mol, and CoO was 20.5% by mol were mixed with 0.6 parts by mass of CuO by wet ball milling with water as a medium. The mixed powder was dried, and then calcined at 1050° C. for 1.5 hours in the air. The calcined powder was pulverized for 18 hours by wet ball milling with water as a medium. 100 parts by mass of the resultant powder was mixed with 1% by mass of a binder (PVA), granulated, and then pressed to a rectangular shape. The resultant green body was sintered at 1200° C. for 3 hours in the air to form a rectangular sintered body (Sample 5) of 2 mm×2 mm×5 mm having a through-hole having a circular cross section of 0.65 mm in diameter along a center axis. X-ray diffraction revealed that the main phase of the sintered body was Y-type ferrite whose main peak was (110).

EXAMPLE 5

100 parts by mass of main components comprising $Fe_2O_3$, $BaCO_3$ and $CO_3O_4$ in such proportions that $Fe_2O_3$ was 60% by mol, BaO was 19.5% by mol, and CoO was 20.5% by mol were mixed with 0.6 parts by mass of CuO by wet ball milling with water as a medium. The mixed powder was dried, and then calcined at 1050° C. for 1.5 hours in the air. The calcined powder was pulverized for 10 hours by wet ball milling with water as a medium, and mixed with water, a binder (methylcellulose), a lubricant and a plasticizer to prepare a moldable material having a water content of 14.4% by mass. The moldable material was extruded through the die shown in FIG. 8, and dried. The resultant rectangular green body was sintered at 1150° C. for 3 hours in the air, to obtain rectangular sintered bodies (Samples 6 and 7) each having a through-hole with a circular cross section along a center axis, and a chamfered curve surface of 0.12 mm in width D at each corner, and a rectangular sintered body (Sample 8) having a chamfered curve surface of 0.5 mm in width D at each corner. X-ray diffraction revealed that the main phases of Samples 6-8 were Y-type ferrite.

Figure 12:
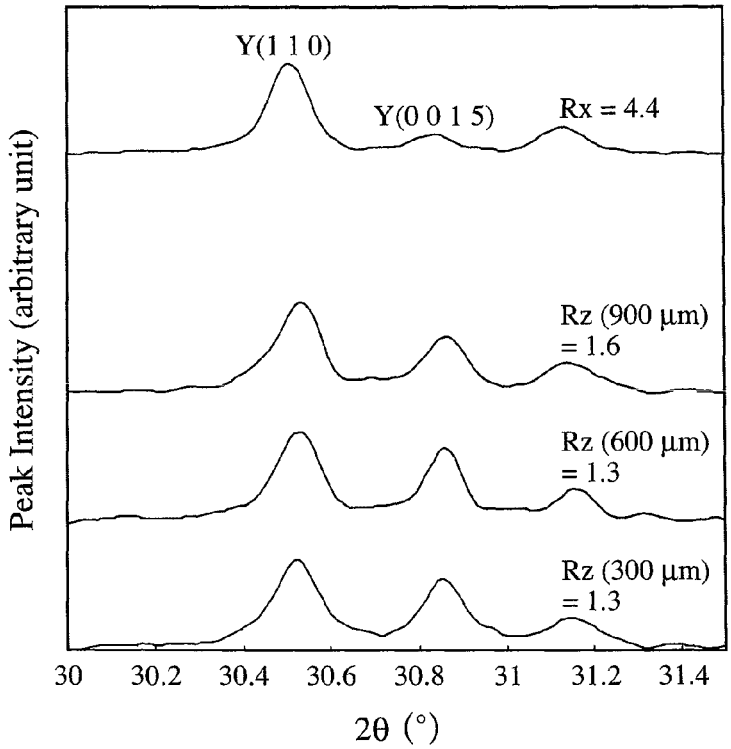
FIG. 12 is a graph showing the X-ray diffraction pattern of Sample 8.

The peak intensity ratios I(110)/I(0015) of Y-type ferrite were determined as Rx, Ry and Rz from X-ray diffraction patterns obtained in a cross section X perpendicular to the through-hole, a cross section Y in a longitudinal direction including the center axis of the through-hole, and a cross section Z (at depth of 0.3 mm from the surface) perpendicular to the cross sections X and Y. The results are shown in Table 2. With respect to Sample 8, Rz was determined from X-ray diffraction patterns (FIG. 12) at depth of 0.3 mm, 0.6 mm and 0.9 mm, respectively. The results are shown in Table 3.

TABLE 2

| Sample | Production Method | Size (mm) of Magnetic Substrate | Diameter (mm) of Penetrating Hole |
|---|---|---|---|
| 5 | Pressing | 2 × 2 × 5 | 0.65 |
| 6 | Extrusion | 2 × 2 × 5 | 0.65 |
| 7 | Extrusion | 2 × 2 × 5 | 0.80 |
| 8 | Extrusion | 3 × 3 × 10 | 0.65 |

| Sample | Rx | Ry | Rz | Rz/Rx | Rz/Ry |
|---|---|---|---|---|---|
| 5 | 1.6 | 3.0 | 3.1 | 1.9 | 1.0 |
| 6 | 3.9 | 2.0 | 1.3 | 0.3 | 0.7 |
| 7 | 4.2 | 2.2 | 1.3 | 0.3 | 0.6 |
| 8 | 4.4 | 2.0 | 1.3 | 0.3 | 0.6 |

TABLE 3

| Sample 8 | Depth of Cross Section Z 0.3 mm | 0.6 mm | 0.9 mm |
|---|---|---|---|
| Rz | 1.3 | 1.3 | 1.6 |
| Rz/Rx | 0.3 | 0.3 | 0.4 |

Sample 5 obtained by pressing was compared with Samples 6-8 obtained by extrusion with respect to Rx, Ry, Rz, Rz/Rx and Rz/Ry. In Sample 5, Ry was substantially the same as Rz, and Rx was as small as about 1.6. On the other hand, Rz was extremely smaller than Rx and Ry in Samples 6-8. Rz was as small as 1.3 at the depth of up to 0.6 mm from the surface (about half of the distance from the through-hole to the outer surface), indicating that the c-planes were aligned with the extrusion direction (axial direction of the through-hole). Accordingly, as shown in FIG. 6(*a*), the c-planes were oriented in a direction circulating around the through-hole. Namely, the c-axis of Z-type ferrite (magnetic phase) was oriented not only in a cross section perpendicular to the through-hole, but also in a longitudinal cross section including the center axis of the through-hole as shown in FIG. 6(*b*). Such orientation provides high permeability in a circumferential direction with the through-hole as a center axis, suitable for chip antennas having magnetic paths in that direction. In Samples 6-8, Rz/Rx was as small as 0.3, and Rz/Ry was as small as 0.7 or less.

EXAMPLE 6

A rectangular magnetic substrate of 3 mm×3 mm×30 mm was produced under the same conditions as in Example 3 using an extrusion method, and a copper wire of 0.6 mm in diameter penetrated its through-hole of 0.65 mm in diameter to produce a chip antenna. This chip antenna was soldered to a feed electrode and a fixing electrode on a printed circuit board of 40 mm in width, to produce an antenna apparatus A shown in FIG. 9. The fixing electrode 13 was 3.5 mm in width, and the feed electrode 14 was 1 mm×13 mm. An end of the fixing electrode 13 was separate from a ground electrode 17 by 1 mm. The fixing electrode 13 was made wide to provide large electrostatic capacitance between the end portion of the fixing electrode 13 and the ground electrode 17 to lower a resonance frequency, thereby miniaturizing the chip antenna. The ground electrode 17 was opposing the chip antenna in parallel with a gap of 11 mm. A matching circuit 16 had the structure shown in FIG. 10(*b*), with C1 of 0.5 pF, L1 of 68 nH, and L2 of 18 nH. A feed circuit 15 was connected to the other end portion of the inductor L2 via a coaxial cable of 50Ω and an antenna-gain-evaluating apparatus.

COMPARATIVE EXAMPLE 1

100 parts by mass of main components comprising $Fe_2O_3$, $BaCO_3$ and $CO_3O_4$ in such proportions that $Fe_2O_3$ was 60% by mol, BaO was 19.5% by mol, and CoO was 20.5% by mol were mixed with 0.6 parts by mass of CuO for 16 hours by wet ball milling with water as a medium. The mixed powder was dried, and then calcined at 1000° C. for 2 hours in the air. The calcined powder was pulverized for 18 hours by wet ball milling with water as a medium, and water, a binder, a lubricant and a plasticizer were added to conduct granulation. The granulated powder was pressed, and sintered at 1200° C. for 3 hours in the air. The sintered body was cut to form a rectangular magnetic substrate of 30 mm×3 mm×3 mm This magnetic substrate was printed with an Ag—Pt paste, and baked to form a 0.8-mm-wide helical electrode of 12 turns to produce a chip antenna. A printed circuit board was provided with a feed electrode and a ground electrode, and one end portion of the electrode of this chip antenna was connected to the feed electrode to produce an antenna apparatus B. The antenna apparatus B did not have a fixing electrode and a matching circuit. The ground electrode was opposing the chip antenna with a gap of 11 mm.

Figure 13:
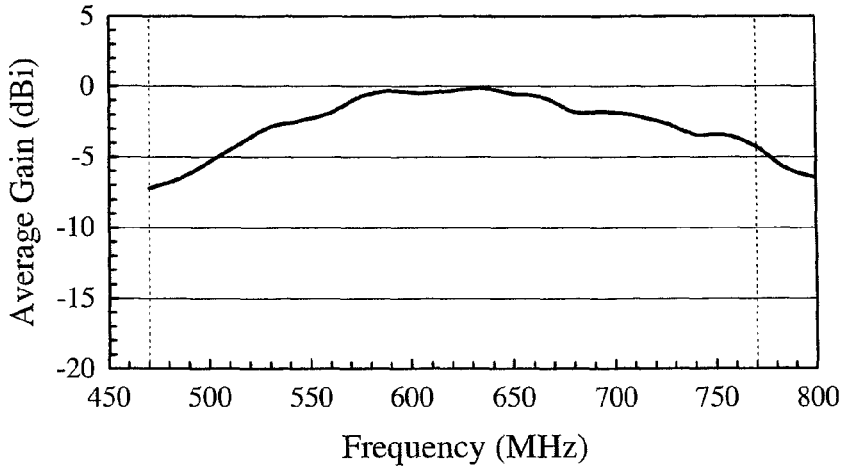
FIG. 13 is a graph showing the frequency characteristics of an average gain of the antenna apparatus of Example 6.

The antenna characteristics (average gain and resonance frequency) of each antenna apparatus A, B disposed at a distance of 3 m from a measuring antenna were measured by an antenna-gain-evaluating apparatus. FIG. 13 shows the average gains of the antenna apparatus A in three directions. The antenna apparatus A had a wide band width; a band width of −7 dB or more being 330 MHz (475-800 MHz), and a band width of −5 dB or more being 275 MHz (503-778 MHz). Having a band width of 330 MHz means that one antenna apparatus can cover a band of 470-770 MHz without switching a matching circuit. On the other hand, the antenna apparatus B comprising a chip antenna having a helical electrode had a narrow band width; a band width of −7 dB or more being 209 MHz (477-686 MHz), and a band width of −5 dB or more being 160 MHz (500-660 MHz).

EXAMPLE 7

Each of a chip antenna comprising the magnetic substrate (Sample 5) obtained by pressing, and a chip antenna comprising the magnetic substrate (Sample 8) obtained by extrusion was attached to an antenna apparatus, to measure average gain and VSWR. The size of each magnetic substrate was 3 mm×3 mm×30 mm for measuring the average gain, and 2 mm×2 mm×10 mm for measuring VSWR. The through-hole had a diameter of 0.65 mm for both measurements. The results are shown in FIGS. 14 and 15.

Figure 14:
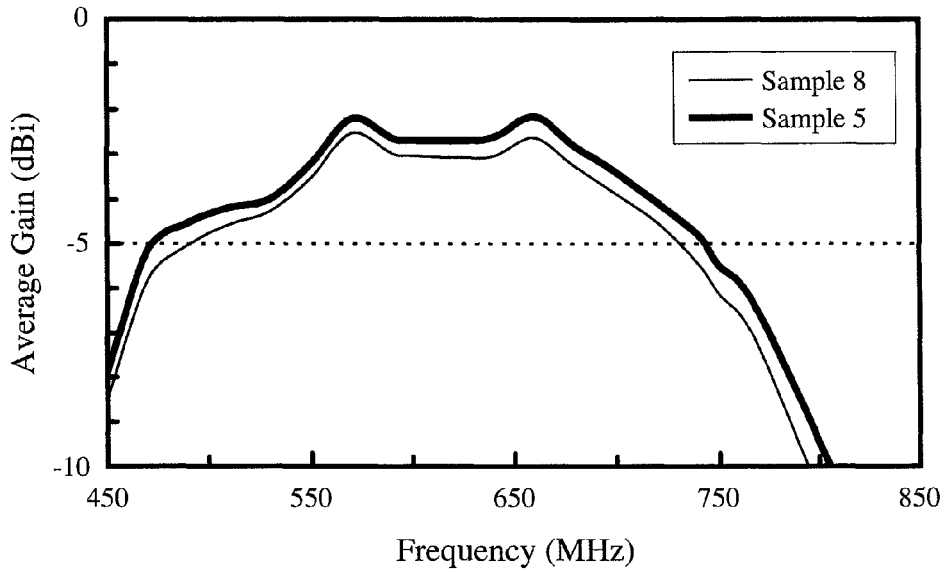
FIG. 14 is a graph showing the frequency characteristics of an average gain of each antenna apparatus comprising the chip antenna of Sample 5 or 8.
Figure 15:
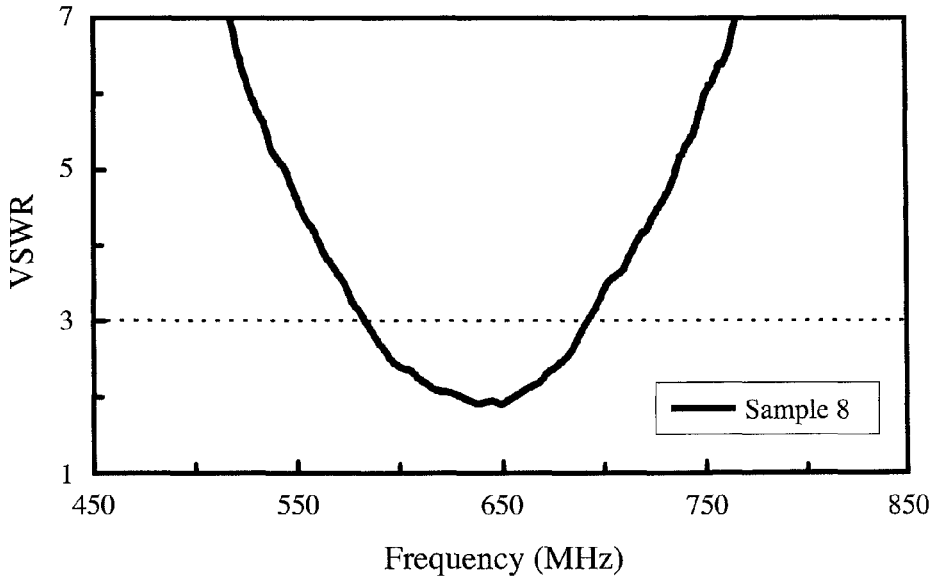
FIG. 15 is a graph showing the frequency characteristics of VSWR of each antenna apparatus comprising the chip antenna of Sample 5 or 8.

As is clear from FIG. 14, the average gain of Sample 5 was higher than that of Sample 8 by 1 dB or more in a range of 470-770 MHz, a digital terrestrial television band. As is clear from FIG. 15, the VSWR of Sample 8 was as good as 4-5 or less in a range of 550-750 MHz. Of course, the VSWR of Sample 8 was practically sufficient in a range of 470-770 MHz, a digital terrestrial television band.

EFFECT OF THE INVENTION

The chip antenna of the present invention is small and suitable for a wide frequency band, thereby providing antenna apparatuses and communications apparatuses with wide frequency band.

What is claimed is:

1. A chip antenna comprising a magnetic substrate comprising Z-type ferrite or Y-type ferrite as a main phase and having a through-hole extending linearly along a center axis, and a conductor penetrating said through-hole, said magnetic phase having a c-axis substantially parallel to said through-hole.

2. The chip antenna according to claim 1, wherein a ratio Rz/Rx is 1.5 or more, wherein Rz is a peak intensity ratio [I(1016)/I(0018) in the case of Z-type ferrite, and I(110)/I(0015) in the case of Y-type ferrite] in an X-ray diffraction pattern of a 0.3-mm-deep cross section in parallel to a longitudinal cross section including a center axis of said through-hole, and Rx is a peak intensity ratio [I(1016)/I(0018) in the case of Z-type ferrite, and I(110)/I(0015) in the case of Y-type ferrite] in an X-ray diffraction pattern of a cross section perpendicular to said through-hole.

3. A chip antenna comprising a magnetic substrate comprising Z-type ferrite or Y-type ferrite as a main phase and a through-hole extending linearly along a center axis, and a conductor penetrating said through-hole, said magnetic phase having a c-axis substantially perpendicular to said through-hole.

4. The chip antenna according to claim 3, wherein a peak intensity ratio Rz [I(1016)/I(0018) in the case of Z-type ferrite, and I(110)/I(0015) in the case of Y-type ferrite] is 1.6 or less in an X-ray diffraction pattern of a 0.3-mm-deep cross section in parallel to a longitudinal cross section including a center axis of said through-hole, and a peak intensity ratio Rx [I(1016)/I(0018) in the case of Z-type ferrite, and I(110)/I(0015) in the case of Y-type ferrite] is 3.5 or more in an X-ray diffraction pattern of a cross section perpendicular to said through-hole.

5. The chip antenna according to claim 4, wherein a ratio Rz/Rx at depth of 0.3 mm is 0.45 or less.

6. The chip antenna according to claim 3, wherein a peak intensity ratio Ry [I(1016)/I(0018) in the case of Z-type ferrite, and I(110)/I(0015) in the case of Y-type ferrite] is 2.5 or less in an X-ray diffraction pattern of a longitudinal cross section including a center axis of said through-hole.

7. The chip antenna according to claim 6, wherein a ratio Rz/Ry at depth of 0.3 mm is 0.8 or less.

8. The chip antenna according to claim 3, wherein the orientation of the c-axes of said magnetic phase in said magnetic substrate is more aligned in the magnetic substrate surface and said through-hole plane than in an intermediate portion therebetween.

9. The chip antenna according to claim 3, wherein said magnetic substrate has an as-sintered outer surface.

10. A chip antenna assembly comprising pluralities of chip antennas recited in claim 1, whose conductors are connected in series.

11. An antenna apparatus comprising the chip antenna recited in claim 1, said conductor having one open end and the other end portion connected to a feed circuit.

12. An antenna apparatus comprising the chip antenna assembly recited in claim 10, said conductor having one open end and the other end portion connected to a feed circuit.

13. A communications apparatus comprising the antenna apparatus recited in claim 11.

14. A method for producing a chip antenna comprising a magnetic substrate comprising Z-type ferrite or Y-type ferrite as a main phase and having a through-hole extending linearly along a center axis, said magnetic phase having a c-axis substantially perpendicular to said through-hole, and a conductor penetrating said through-hole, comprising the steps of extruding a moldable material containing magnetic powder having said magnetic phase to form said magnetic substrate, and inserting said conductor into the through-hole of said magnetic substrate.

* * * * *